United States Patent [19]

Tomlinson

[11] Patent Number: 4,787,871

[45] Date of Patent: Nov. 29, 1988

[54] WATER SURFACE RUNNING FINS FOR THE FEET

[76] Inventor: Peter B. Tomlinson, 309 Asharoken Ave., Northport, N.Y. 11768

[21] Appl. No.: 146,565

[22] Filed: Jan. 21, 1988

[51] Int. Cl.[4] ..... A63B 31/08

[52] U.S. Cl. ..... 441/61; 441/64; 441/65

[58] Field of Search ..... 441/60, 61, 65, 64, 441/76

[56] References Cited

U.S. PATENT DOCUMENTS 1,788,013 1/1931 Christianson ..... 441/64

4,264,994 5/1981 Carbone ..... 441/64

FOREIGN PATENT DOCUMENTS 351932 4/1922 Fed. Rep. of Germany ..... 441/61

*Primary Examiner*—Joseph F. Peters, Jr.

*Assistant Examiner*—Edwin L. Swinehart

*Attorney, Agent, or Firm*—Richard L. Miller

[57] ABSTRACT

These water running fins are designed to be worn on a person's feet to enable the user to effectively run on the surface of a body of water. Primarily, the fin consists of a main body with a foot receiving member attached, and the main body is provided with forward spoke portions attached to a web portion. The structure further includes a multiple number of first fingers and second fingers pivotally attached by wires that serves as the pivots, and over upward travel of the fingers is limited by the rear portions of the fingers being rearward of the pivot points.

4 Claims, 1 Drawing Sheet

WATER SURFACE RUNNING FINS FOR THE FEET

BACKGROUND OF THE INVENTION

The instant invention relates generally to aquatic devices, and more particularly, to water surface running fins for the feet.

Numerous aquatic devices have been provided in the prior art that are adapted to be worn on one's feet. For example, U.S. Pat. Nos. 3,112,504 of Charlton, 1,061,264 of Bys, and 579,695 of Morreale, all are illustrative of such prior art. While these units may be suitable for the particular purpose to which they address, they would not be as suitable for the purpose of the present invention as hereafter described.

SUMMARY OF THE INVENTION

A primary object of the present invention is to provide water surface running fins for the feet that will overcome the shortcomings of the prior art devices.

Another object is to provide water surface running fins for the feet that will enable a wearer to sustain his weight on water with a vigorous forward running motion.

An additional object is to provide water surface running fins for the feet that will enable a rigid power stroke and a semi-collapsed state for the return stroke, and the fins which are not floatation devices.

Some of the uses for the present invention, are as follows:

1. SPORTING
   a. Recreation;
   b. Exercise;
   c. Competitive racing; and
   d. Testing of the necessary skill and endurance among a group.
2. LIFE SAVING
   a. A lifeguard may quickly convey a light floatation life saving device to an offshore swimmer in danger, and employ the fins as powerful flippers to assist the person ashore.
   b. Because of the much increased foot area, a wearer would be better able to sustain his weight on ice in the rescue of one who has fallen through the ice.

A further object is to provide water surface running for the feet that is simple and easy to use.

A still further object is to provide water surface running fins for the feet that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
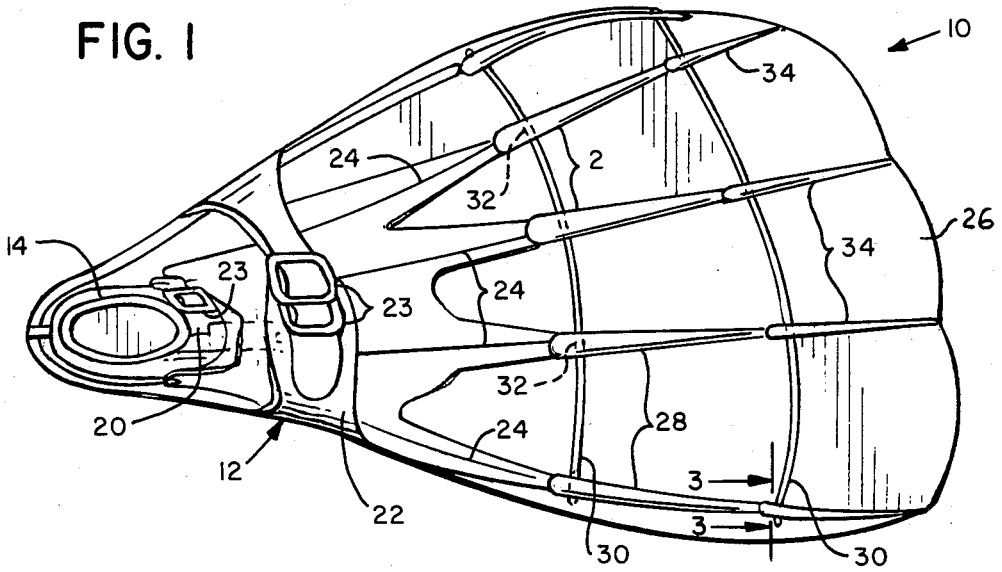
FIG. 1 is a diagrammatic top plan view of the invention.

Turning now descriptively to the drawings, in which like reference characters denote like elements throughout the several views, a fin 10 is shown to include a main body 12 having a foot receiving member 14 integrally attached. Foot 16 of a wearer 18 is secured in member 14 by a first adjustable belt 20 and a second adjustable belt 22, and both belts, 20 and 22 are fixedly secured to the sides of the rear portion of main body 12. Belts 20 and 22 are provided with buckles 23 for adjustment thereof, and main body 12 is also provided with a plurality of spaced spoke portions 24 integrally attached and extending forwardly having a web portion 26 integrally attached.

Inverted U-shaped first fingers 28 are freely received on spoke portions 24, and are pivotally attached thereto, by a flexible wire received in openings 32 of spoke portions 24 and first fingers 28. A plurality of pivotal second fingers 34 are received on the forward portions of first fingers 28, and a second wire 30 similarly secures second fingers 34 to first fingers 28, and it shall be noted that spoke portions 24, first fingers 28, and second fingers 34 are all tapered forward for providing the necessary degree of flexibility forwardly, and web portion 26 is also integrally attached to first fingers 28 and second fingers 34.

Figure 4:
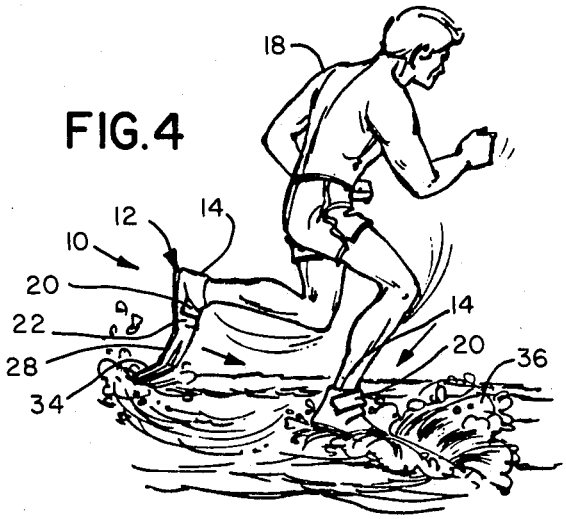
FIG. 4 is a diagrammatic view illustrating the invention in use.
Figure 2:
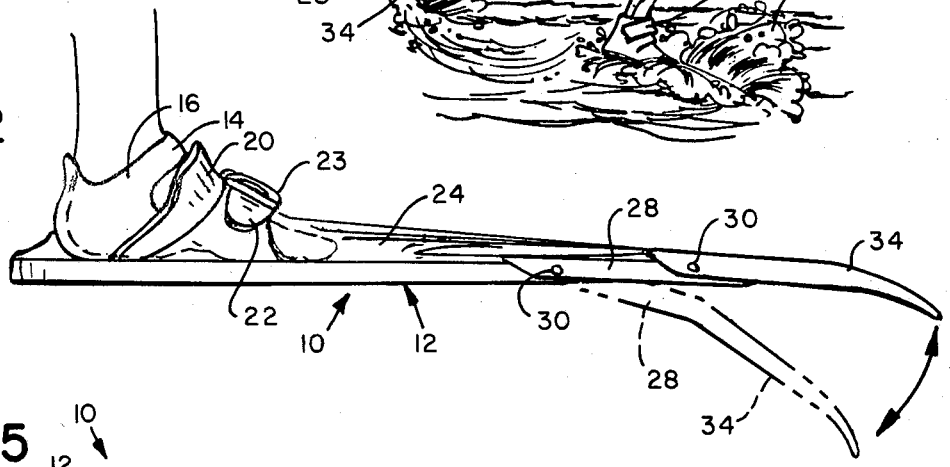
FIG. 2 is a diagrammatic side view of FIG. 1, shown in elevation and being worn on the left foot of a person.
Figure 5:
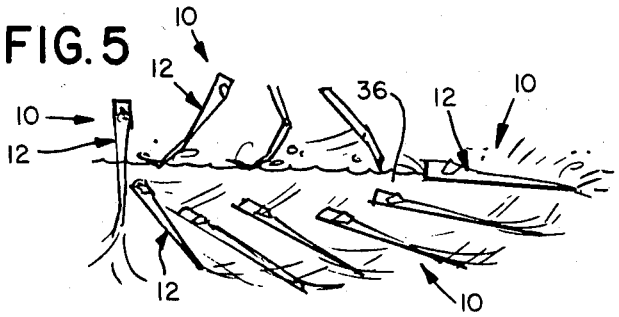
FIG. 5 is a diagrammatic side view showing the various positions of the fin when effecting the forward running motion on water.
Figure 3:
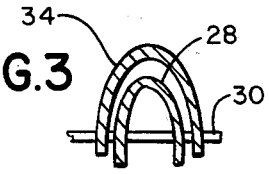
FIG. 3 is an enlarged diagrammatic cross sectional view, taken along the line 3—3 of FIG. 1.

In operation when the user 18 runs vigorously forward on the water 36, as illustrated in FIGS. 4 and 5, the smaller fingers 34 pivot in a greater radius than the larger fingers 28, causing less water drag in preparation for the next forward motion stroke, which is when both first fingers 28 and second fingers 34 return to horizontal position, and this horizontal position is maintained by a stop action when water force is against the bottom of fin 10. This stopping of upward pivoting of fingers 34 and 28, is due to the rear portions of 34 and 28 being rearward of the pivot wires 30.

It shall also be recognized that all of the components herein described, with the exception of the wires 30 and the buckles 23, may be fabricated preferably of flexible rubber, plastic material, other light weight synthetic materials.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A fin for water surface running by a wearer, comprising, a main body, a foot receiving member secured to a rear portion of said main body, a plurality of spaced spoke portions secured to said body, providing a means for mounting and pivotally receiving a plurality of first fingers, a plurality of pivotal second fingers received on said first fingers, and a pair flexible wires received through said first fingers and said second fingers, providing upward stop means of pivoting of said first fingers and said second fingers.

2. A fin for water surface running as set forth in claim 1, wherein said spoke portions are integrally attached to said main body and taper forward, and each spoke portion freely receives a larger end of one of said first fingers that is of inverted U-shape and tapered, and one of the said pair of wires is received in a forward opening of each said spoke portion and an opening through said first fingers.

3. A fin for water surface running as set forth in claim 2, wherein another of said pair of wires is received in an opening provided through a forward end of said first fingers and an opening provided through a rear end of said second fingers which taper forward and are U-shaped in configuration.

4. A fin for water surface running as set forth in claim 3, wherein a rear end of said first fingers is received on top of a forward end of said spoke portions, and a rear end of said second fingers is received on top of a forward end of said first fingers, and pivot points of both said first fingers and said second fingers, are forward of rear ends of said first fingers and said second fingers, causing said rear ends to serve as said stop means against upward travel of said first fingers and said second fingers, as said forward end of said spoke portions engages with said rear ends of said first fingers, and said rear ends of said second fingers engage with forward ends of said first fingers, and normal pivot movement of said first fingers and said second fingers is downward.

* * * * *